US006801894B2

(12) United States Patent
Nakamura et al.

(10) Patent No.: US 6,801,894 B2
(45) Date of Patent: Oct. 5, 2004

(54) SPEECH SYNTHESIZER THAT INTERRUPTS AUDIO OUTPUT TO PROVIDE PAUSE/ SILENCE BETWEEN WORDS

(75) Inventors: Yoshihisa Nakamura, Miyazaki (JP); Hiroaki Matsubara, Kanagawa (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 487 days.

(21) Appl. No.: 09/814,065

(22) Filed: Mar. 22, 2001

(65) Prior Publication Data

US 2001/0025243 A1 Sep. 27, 2001

(30) Foreign Application Priority Data

Mar. 23, 2000 (JP) ..... 2000-082699

(51) Int. Cl.[7] ..... G10L 13/04; G10L 13/06; G10L 11/06

(52) U.S. Cl. ..... 704/258; 704/266; 704/261; 704/215

(58) Field of Search ..... 704/274, 267, 704/212, 504, 215, 258, 264, 265, 261, 266; 340/825.2

(56) References Cited

U.S. PATENT DOCUMENTS 3,694,811 A * 9/1972 Wood ..... 340/825.2
4,130,730 A * 12/1978 Ostrowski ..... 704/264
4,398,059 A * 8/1983 Lin et al. ..... 704/267
4,412,099 A * 10/1983 Niyada et al. ..... 704/258
4,433,210 A * 2/1984 Ostrowski et al. ..... 704/265
4,449,190 A * 5/1984 Flanagan et al. ..... 704/215
4,519,027 A * 5/1985 Vogelsberg ..... 704/274
4,701,937 A * 10/1987 Wan et al. ..... 704/504
4,989,246 A * 1/1991 Wan et al. ..... 704/212

OTHER PUBLICATIONS

Rahier et al ("A 3 /spl mu/m NMOS High–Performance LPC Speech Synthesizer Chip", IEEE Journal of Solid–State Circuits, Jun. 1983).*

Gomi et al ("A Multi–Functional Telephone With Conversational Responses And Pause Deletion Recording", IEEE Transactions on Consumer Electronics, Aug. 1988).*

* cited by examiner

*Primary Examiner*—Richemond Dorvil
*Assistant Examiner*—Daniel A Nolan
(74) *Attorney, Agent, or Firm*—Junichi Mimura

(57) ABSTRACT

A speech synthesizer includes a data memory having a plurality of address areas, which stores a plurality of phases in the address areas and an address designating circuit designating one of the address areas based on the phase signal. Further, a speech synthesizer includes a speech synthesizing circuit generating a speech synthesizing signal corresponding to the phase, which is stored in the designated area, a digital/analog converter transforming the speech synthesizing signal to an analog signal having amplitude, and a counter setting a period of silence. Furthermore, a speech synthesizer includes a silence-input circuit being connected between the speech synthesizing circuit and the digital/analog converter, which supplies a predetermined voltage to the digital/analog converter for the period that is set by the counter.

22 Claims, 5 Drawing Sheets

SPEECH SYNTHESIZER THAT INTERRUPTS AUDIO OUTPUT TO PROVIDE PAUSE/ SILENCE BETWEEN WORDS

CROSS-REFERENCE TO RELATED APPLICATION

This application claims the priority benefit of Japanese Patent Application No. 2000-82699, filed Mar. 23, 2000, the entire disclosure of which is incorporated herein by reference.

BACKGROUND OF THE INVENTION

1. Field of the Invention

The invention relates to a speech synthesizer for synthesizing speech and for regenerating speech and, more specifically, to a speech synthesizer being incorporated in an integrated circuit (IC) chip.

2. Description of the Related Art

A sentence comprises phrases. For example, the sentence "It is five-twenty P.M." can be divided into three phrases, "it is", "five-twenty" and "P.M.". In a speech synthesizer of the related art, these phrases are stored in a data ROM 5, and are synthesized to regenerate speech. FIG. 5 shows a block diagram of a speech synthesizer 1 in the related art, which is incorporated in an IC chip. The speech synthesizer includes an input terminal IN, a latch circuit 2, an address read only memory (ROM) 3, an address counter 4, a data ROM 5, a speech synthesizing circuit 6, a digital/analog converter (DAC) 7, a low pass filter (LPF) 8, and a timing control circuit 9.

The speech synthesizer 1 receives phrase signals at the input terminal IN. Each of the phrase signals designates one of the phrases of the sentence and is supplied from an external device. The input terminal IN is connected to the latch circuit 2. An output terminal of the latch circuit 2 is connected to the address ROM 3. The address ROM 3 designates address areas, each of which corresponds to one of the phrases. An output terminal of the address ROM 3 is connected to a preset terminal of the address counter 4. An output terminal of the address counter 4 is connected to the data ROM 5. The address counter 4 sends addresses, each of which corresponds to one of the phrases, to the data ROM one-by-one. The data ROM stores speech data in Adaptive Differential Pulse Code Modulation (ADPCM) format, and each of the speech data corresponds to the one of the addresses. That is, groups of the speech data, which correspond to a plurality of phrases, are stored in the data ROM 5.

An output terminal of the data ROM 5 is connected to the speech synthesizing circuit 6. An output terminal of the speech synthesizing circuit 6 is connected to the LPF 8 via the DAC 7. The LPF 8 includes a plurality of operational amplifiers and a reference voltage generating circuit 8*a*. The reference voltage generating circuit 8*a* generates a signal-ground SG, which serves as a reference voltage for each operational amplifier. The voltage level of the signal-ground is set at ½ level of the power supply voltage VDD. An output terminal of the LPF 8 is connected to a speech output terminal OUT. The timing control circuit 9 receives a clock signal which is applied to a clock terminal CK, and then, controls the timing for synthesizing speech in the speech synthesizing circuit 6.

An operation of the speech synthesizer 1 shown in FIG. 5 is explained as follows. First, the phrase signal, which is applied to the phrase input terminal IN, is latched at the latch circuit 2. Then, based on the latched phrase signal, the address ROM 3 selects an address area, which corresponds to the phrase. The address ROM 3 outputs an initial address of the selected address area to the preset terminal of the address counter 4.

The address counter 4 counts up from the initial address, and send a result of the count as a designated address to the data ROM 5. The data ROM 5 sends speech data at the designated address, which corresponds to the phrase, to the speech synthesizing circuit 6.

The speech synthesizing circuit 6 synthesizes the speech data received from the data ROM 5, and expands the synthesized data to PCM data in digital format. Then, the PCM data is outputted to the DAC 7. The DAC 7 transforms the PCM data to an analog signal, and then sends the analog signal to the LPF 8. The LPF 8 filters high frequencies out from the analog signal, and then passes the filtered analog signal to the speech output terminal OUT, whereby an analog speech signal, which corresponds to the phrase, is provided as a result of speech synthesis.

However, since a plurality of synthesized phrases in this manner may be outputted serially, they are unpleasant to hear unless silence for a particular period is inserted between the phrases outputted from the terminal OUT Therefore, in this speech synthesizer of the related art, which is shown in FIG. 5, silence data is stored as a part of each phrase in the data ROM 5 in order to insert silence between the phrases. By reading out the phrase including the silence data, the speech synthesizer shown in FIG. 5 can output pleasant sounding synthesized speech.

However, the data ROM 5 must have a large capacity in order to store the silence data for each phrase therein in the speech synthesizer of the related art. In view of cost-performance requirements, it is desirable that the capacity of the data ROM be reduced while the quality of the sound of the speech synthesizer is maintained.

SUMMARY OF THE INVENTION

It is therefore an objective of the invention is to provide a speech synthesizer, in which the memory capacity for storing speech data is reduced without degrading sound quality.

According to one aspect of the invention, the following speech synthesizer is presented to achieve this objective. That is, a speech synthesizer includes a data memory having a plurality of address areas, which stores a plurality of phrases in the address areas, and an address designating circuit designating one of the address areas based on a phrase signal.

Further, the speech synthesizer includes a speech synthesizing circuit generating a speech synthesizing signal based on the phrase, which is stored in the designated area, a digital/analog converter transforming the speech synthesizing signal to an analog signal, and a counter setting a period of silence.

Furthermore, a speech synthesizer includes a silence-input circuit being connected between the speech synthesizing circuit and the digital/analog converter, which supplies a predetermined voltage to the digital/analog converter for the silence period that is set by the counter.

The above and further objects and novel features of the invention will more fully appear from the following detailed description, appended claims and accompanying drawings.

DETAILED DESCRIPTION OF THE PREFERRED EMBODIMENTS

First Preferred Embodiment

Figure 1:
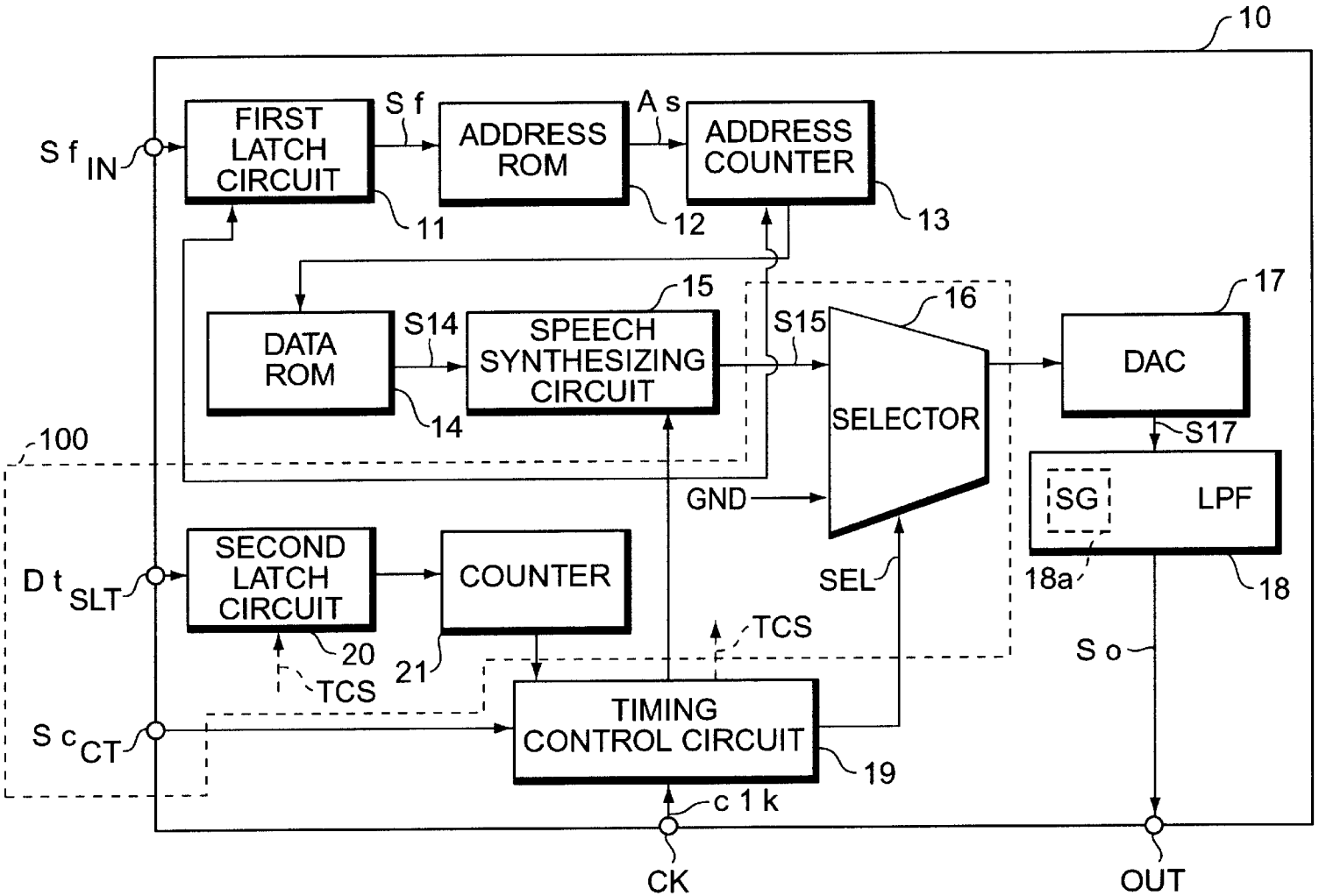
FIG. 1 is a block diagram of a speech synthesizer according to a first embodiment of the invention.

Referring to FIG. 1, a speech synthesizer 10 includes an input terminal IN, a first latch circuit 11, an address read only memory (ROM) 12, an address counter 13 having a preset terminal, a data ROM 14, a speech synthesizing circuit 15, a digital/analog converter (DAC) 17, a low pass filter (LPF) 18, a timing control circuit 19 and a silence-input circuit 100. The silence-input means 100 is for inserting silence between phrases, and includes a silence-length setting terminal SLT, a second latch circuit 20, a counter 21 for setting a length of silence, a two-input selector 16 and a control terminal CT.

The speech synthesizer 1, which is formed in an IC chip, receives phrase signals Sf, each of which designates one of the phrases of a sentence, at the input terminal IN. These phrase signals Sf are supplied from an external device. The input terminal IN is connected to the first latch circuit 11. An output terminal of the first latch circuit 11 is connected to the address ROM 12. An output terminal of the address ROM 12 is connected to the preset terminal of the address counter 13. In the address ROM 12, address data are stored, and each address data shows an initial address of one of speech data stored in data ROM 14. The address ROM 12 sends the initial address As to the address counter 13. The address counter 13 performs counting operation, and produces addresses corresponding to the phrase signals one-by-one. An output terminal of the address counter 12 is connected to the data ROM 14, which is used as a speech data memory. An output terminal of the data ROM 14 is connected to the speech synthesizing circuit 15.

An output terminal of the speech synthesizing circuit 15 is connected to one of two data input terminals of the two-input selector 16 of the silence-input means 100. The other data input terminal of the two-input selector 16 is connected to ground GND. An output of the two-input selector 16 is connected to the DAC 17. An output of the DAC 17 is connected to the LPF 18.

The data ROM 14 stores speech data S14 in Adaptive Differential Pulse Code Modulation (ADPCM) format, which must be decoded, wherein the speech data S14 stored in each address in the data ROM 14 corresponds to one of the phrases. However, since the content in the data ROM 14 is just a list of data in ADPCM format, a start and an end of each phrase can not be recognized by simply referring the content in the data ROM 14. That is, each phrase can not be recognized. To recognize each phrase, it is necessary to refer to the address data stored in the address ROM 12 in addition to referring to the speech data S14 in the data ROM 14.

The speech synthesizing circuit 15 expands the speech data S14 to the Pulse Code Modulation (PCM) data S15 by decoding. The PCM data S15 is transformed into an analog signal S17 in the DAC 17. The LPF 18 filters high frequencies out from the analog signal S17 outputted from the DAC 17, and then produces an analog speech signal So, which corresponds to the phrase, from the filtered analog signal.

Figure 5:
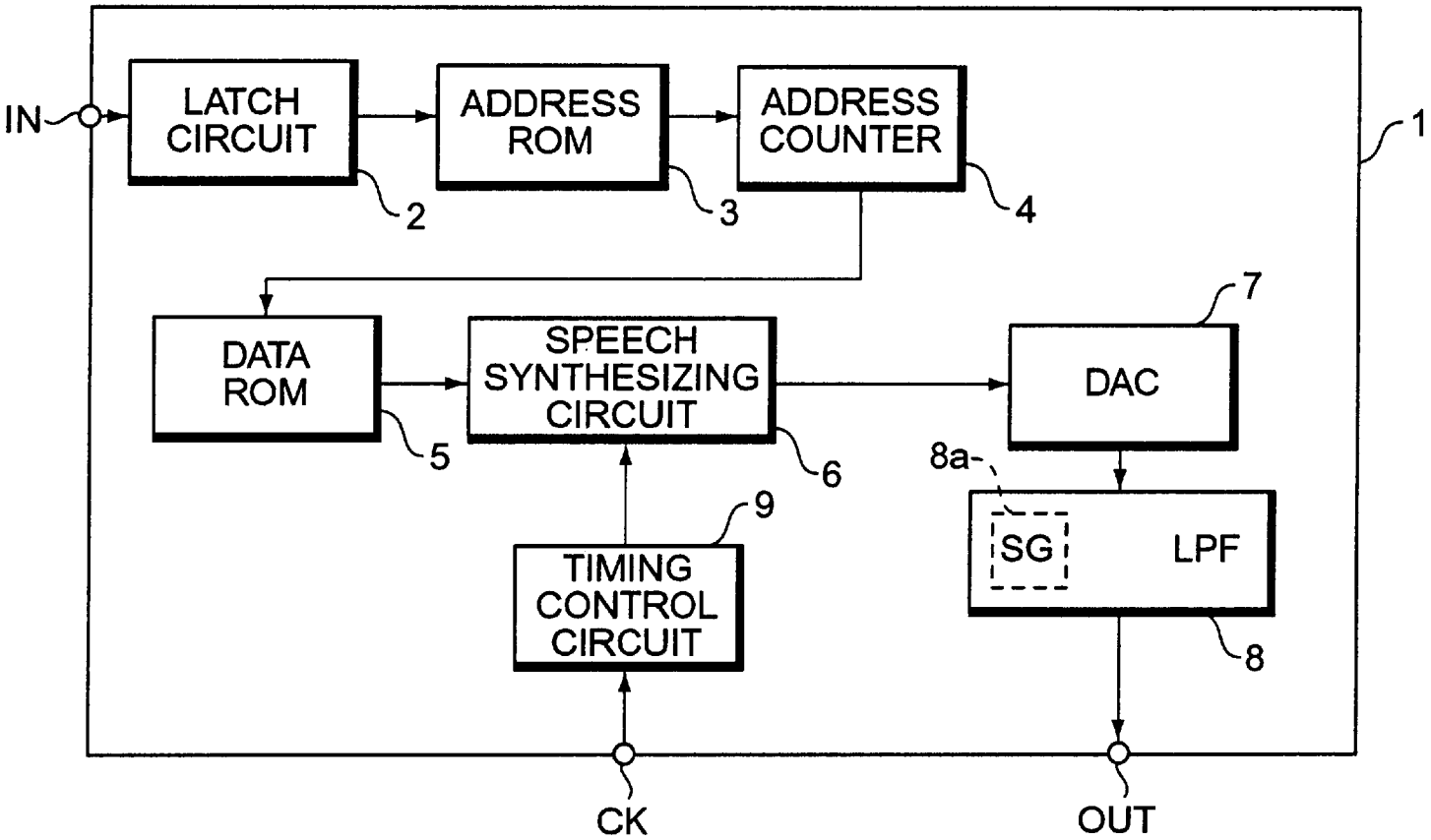
FIG. 5 PRIOR ART
FIG. 5 is a block diagram of a speech synthesizer in the related art.

The LPF 18 includes a plurality of operational amplifiers and a reference voltage generating circuit 18*a*. The reference voltage generating circuit 18*a* generates a signal-ground voltage SG, which serves as a reference voltage for each operational amplifier. The level of the signal-ground voltage is set at ½ level of the power supply voltage VDD. That is, the level of the signal-ground voltage is set around the center level of a whole analog speech waveform. Silence can be obtained by maintaining the output continuously at the signal-ground level for a particular period. An output terminal of the LPF 18 is connected to a speech output terminal OUT The speech synthesizer 10 also includes a clock terminal CK for receiving a clock signal, as in the speech synthesizer 1 of the related art shown in FIG. 5. The control terminal CT receives a control signal Sc, and the silence-length setting terminal SLT receives silence-length data Dt. The control terminal CT and the clock terminal CK are connected to the timing control circuit 19.

The silence-length setting terminal SLT is connected to the second latch circuit 20. An output of the second latch circuit 20 is connected to a preset terminal of the counter 21 for setting the desired length of silence. An output of the counter 21 is connected to the timing control circuit 19.

The timing control circuit 19 controls the timing of the first latch circuit 11, the address counter 13 and the speech synthesizing circuit 15 based on the clock signal CK, which is applied to the clock terminal CK. The timing control circuit 19 sends the select signal SEL, which is based on the result of the counting operation in the counter 21 and the control signal Sc, to an select terminal of the selector 16.

An operation of the speech synthesizer 10 shown in FIG. 1 is explained as follows using "It is two-twenty" as an example of a sentence to be synthesized. In this case, "It is" is a first phrase and "two-twenty" is a second phrase. Speech data, which correspond to these phrases, are stored at their addresses in the data ROM 14, and their initial addresses are stored in the address ROM 12. At first, a control signal Sc, which is applied to the timing control circuit 19, is set at an H level when an analog speech signal So, which corresponds to the first phrase, is outputted. When the first and the second phrase signals Sf designating the first and the second phrase are applied serially to the input terminal IN from an external device, the first latch circuit 11 is instructed from the timing controls circuit 19 for latching these phrase signals Sf, and then sends the first phrase signal Sf to the address ROM 12.

The address ROM 12 selects a first address area, which corresponds to the first phrase signal Sf. Then, the address ROM 12 sends a minimum address in the first address area, as the first initial address As indicating the top of the first phrase, to the preset terminal of the address counter 13.

The address counter 13 counts up from the first initial address As, and produces a first address, corresponding to the first phrase. Then, the first address is sent to the data ROM 14. In response, the data ROM 14 sends first speech data S14, which corresponds to the first address, to the speech synthesizing circuit 15.

In the speech synthesizing circuit 15, the first speech data S14 is synthesized by the instruction from the timing control circuit 19, and the synthesized speech data is expanded to first PCM data S15. Then, the first PCM data S11 is sent to the selector 16.

Since the control signal Sc is at the H level, the timing control circuit 19 outputs the select signal SEL having the H level to the selector 16 in order to select the first PCM data S15. Therefore, the selector 16 transfers the first PCM data S15 to DAC 17.

The DAC 17 decodes the first PCM data S15 to produce a first analog signal S17, and then sends the first analog signal to the LPF 18. The LPF 18 filters high frequencies out from the first analog signal in order to produce a first analog speech signal So, which corresponds to the first phrase. The first analog speech signal So is outputted from the speech output terminal OUT as a result of speech synthesis to an external device such as a speaker. After the first PCM data S15 is outputted from the selector 16, the second phrase signal, which is latched in the first latch circuit 11, is outputted to the address ROM 12 under the control of the timing control circuit 19. In the same manner used to synthesize the first phrase as described above, second PCM data based on the second phrase signal is outputted from the speech synthesizing circuit 15.

To insert silence between the first and the second phrases, the control signal Sc is set at an L level after the first PCM data S15 is outputted from the selector 16, and the silence-length data Dt is supplied to the silence-length setting terminal SLT. Here, since the silence-length data Dt can be stored in the second latch circuit 20, the silence-length data Dt can be inputted anytime before the first PCM data S15 is outputted from the selector 16. When the control signal having the L level is applied to the timing control circuit 19, the timing control circuit 19 outputs the select signal SEL having the L level for making the selector 16 select its input, which is connected to the ground GND. The ground voltage GND is equivalent of "0" in PCM data S15. Therefore, when the ground voltage GND is applied to the DAC 17, the DAC 17 outputs the signal-ground voltage, which corresponds to "0", to the LPF 18.

When the signal-ground voltage is applied to the LPF, the LPF outputs a signal-ground voltage SG, which is generated by the reference voltage generating circuit 18*a*, to the speech output terminal OUT, whereby silence is outputted from the speech synthesizer 10.

In the meantime, the silence-length data Dt, which is applied to the silence-length setting terminal SLT, is latched in the second latch circuit 20. When sending the select signal SEL having the L level to the selector 16, the timing control circuit 19 also sends the timing control signal TCS to the second latch circuit 20. When receiving the timing control signal TCS, the second latch circuit 20 recognizes that a period of silence has started, and sends the silence-length data Dt to the preset terminal of the counter 21.

A countdown of the preset silence-length data Dt is performed in the counter 21. When the counter 21 indicates "0" as a result of the countdown, the timing control circuit 19 outputs the select signal having the H level to the selector 16. When the selector 16 receives the select signal having the H level, the selector 16 selects the input signal from the speech synthesizing circuit 15, whereby the period for the silence is ended, and the second PCM data S15 produced from the second phrase signal is outputted to the DAC 17.

As described above, the period of silence, which corresponds to the silence-length data Dt, is set by the counter 21, and the silence is inserted between the first and the second phrases by the selector 16.

Thus, for the insertion of silence between phrases, the speech synthesizer according to the first embodiment includes the selector 16 for selecting either the PCM data S15 outputted from speech synthesizing circuit 15 or the ground potential GND, and the counter 21 for performing the countdown operation by receiving the silence-length data Dt. The silence is started when the selector 16 selects the ground potential GND, and is ended when the counter 21 indicates "0" as a result of the countdown operation. According to the first embodiment, it is not necessary to store the silence data in the data ROM 14 in order to insert the silence between the phrases. Therefore, it is possible to insert the silence between the phrases without increasing the memory capacity.

Second Preferred Embodiment

Figure 2:
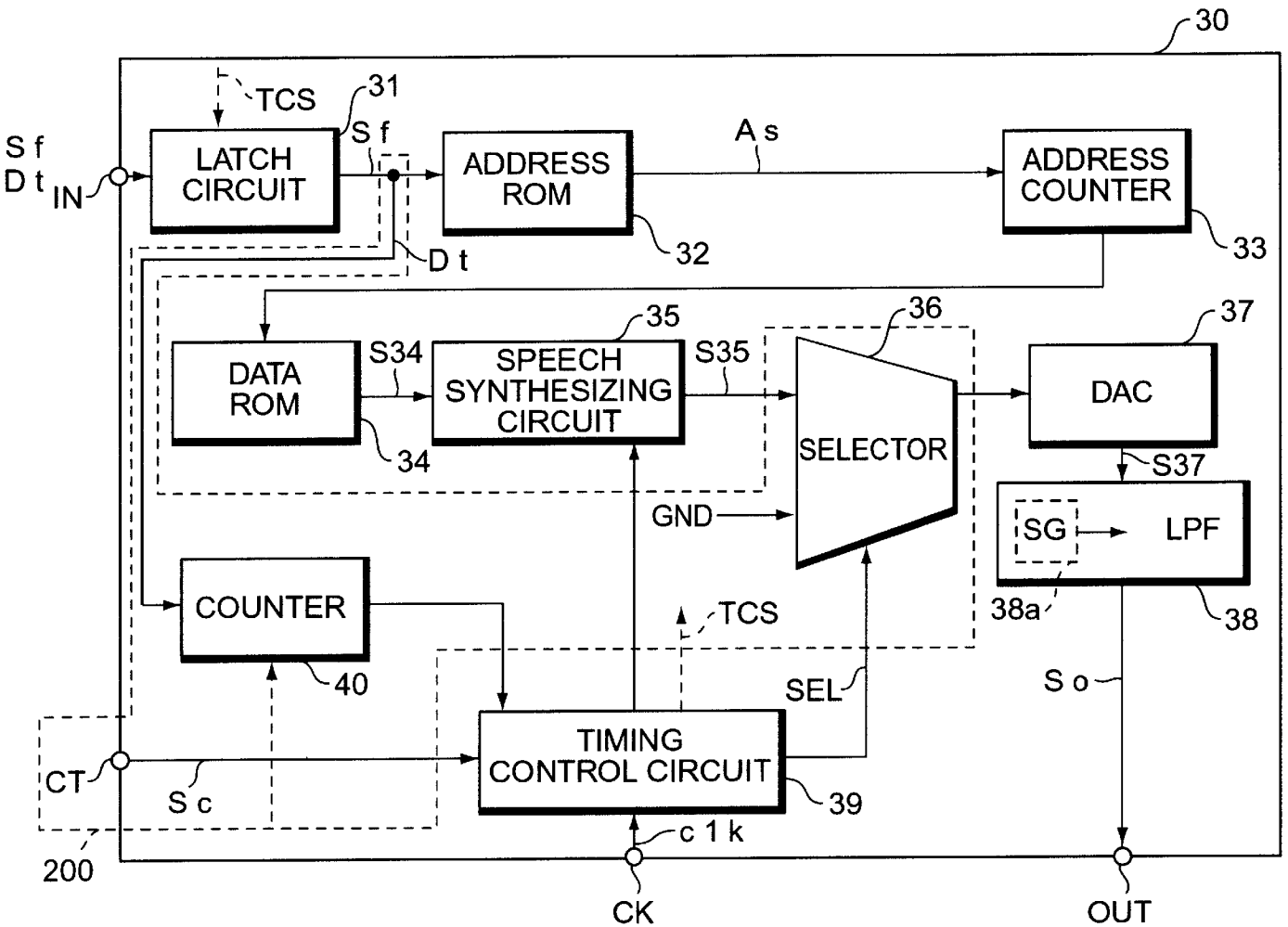
FIG. 2 is a block diagram of a speech synthesizer according to a second embodiment of the invention.

Referring to FIG. 2, a speech synthesizer 30 includes an input terminal IN, a latch circuit 31, an address read only memory (ROM) 32, an address counter 33 having a preset terminal, a data ROM 34, a speech synthesizing circuit 35, a digital/analog converter (DAC) 37, a low pass filter (LPF) 38, a timing control circuit 39 and a silence-input means 200. The silence-input means 200 is for inserting silence between phrases, and includes a counter 40 having a preset terminal for setting a length of silence, a two-input selector 36 and a control terminal CT.

The speech synthesizer 30, which is formed in an IC chip, receives phrase signals Sf, each of which designates one of the phrases of a sentence and silence-length data Dt, at the input terminal IN. The phrase signals Sf and silence-length data Dt are supplied from an external device. The input terminal IN is connected to the latch circuit 31. Functions of the latch circuit 31 is different from these of the first latch circuit 11 shown in FIG. 1. That is, the latch circuit 31 latches not only the phrase signal Sf, but also the silence-length data Dt.

An output terminal of the latch circuit 31 is connected to the address ROM 32. An output terminal of the address ROM 32 is connected to the preset terminal of the address counter 33. In the address ROM 32, address data are stored, and each address data shows an initial address of one of speech data stored in the data ROM 34. The address ROM 32 sends the initial address As to the address counter 33. The address counter 33 performs a counting operation, and produces addresses corresponding to the phrase signals one-by-one. An output terminal of the address counter 33 is connected to the data ROM 34, which is used as a speech data memory. An output terminal of the data ROM 34 is connected to the speech synthesizing circuit 35.

An output terminal of the speech synthesizing circuit 35 is connected to one of two data input terminals of the two-input selector 36 of the silence-input means 200. The other data input terminal of the two-input selector 36 is connected to ground GND. An output of the two-input selector 36 is connected to the DAC 37. An output of the DAC 37 is connected to the LPF 38.

The data ROM 34 stores speech data S34 in Adaptive Differential Pulse Code Modulation (ADPCM) format, which must be decoded, wherein the speech data S34 stored in each address in the data ROM 34 corresponds to one of the phrases. However, since the content in the data ROM 34 is just a list of data in ADPCM format, a start and an end of each phrase can not be recognized by simply referring the content in the data ROM 34. That is, each phrase can not be recognized. To recognize each phrase, it is necessary to refer to the address data stored in the address ROM 32 in addition to referring to the speech data S34 in the data ROM 34.

The speech synthesizing circuit 35 expands the speech data S34 to the Pulse Code Modulation (PCM) data S35 by decoding. The PCM data S35 is transformed into an analog signal S37 in the DAC 37. The LPF 38 filters high frequencies out from the analog signal S37 outputted from the DAC 37, and then produces an analog speech signal So, which corresponds to the phrase, from the filtered analog signal.

The LPF 38 includes a plurality of operational amplifiers and a reference voltage generating circuit 38*a*. The reference voltage generating circuit 38*a* generates a signal-ground voltage SG, which serves as a reference voltage for each operational amplifier. The level of the signal-ground voltage is set at ½ level of the power supply voltage VDD. That is, the level of the signal-ground voltage is set around the center level of a whole analog speech waveform. Silence can be obtained by maintaining the output continuously at the signal-ground level for a particular period. An output terminal of the LPF 38 is connected to a speech output terminal OUT.

The speech synthesizer 30 also includes a clock terminal CK for receiving a clock signal, as in the speech synthesizer 10 shown in FIG. 1 in addition to the control terminal CT for receiving a control signal Sc. However, compared with the speech synthesizer 10 of the first embodiment, the speech synthesizer 30 of the second embodiment does not include any silence-length setting terminals SLT, which is used in the speech synthesizer 10 shown in FIG. 1.

The control terminal CT and the clock terminal CK are connected to the timing control circuit 39. An output of the latch circuit 31 is also connected to the preset terminal of the counter 40 of the silence-input means 200 for setting length of silence. An output of the counter 40 is connected to the timing control circuit 39.

The timing control circuit 39 controls the timing of the latch circuit 31, the address counter 33 and the speech synthesizing circuit 35 based on the clock signal Clk, which is applied to the clock terminal CK. The timing control circuit 39 sends the select signal SEL, which is based on the result of the counting operation in the counter 40 and the control signal Sc, to an select terminal of the selector 36.

An operation of the speech synthesizer 30 shown in FIG. 2 is explained as follows using "It is two-twenty" as an example of a sentence to be synthesized, in the second embodiment. In this case, "It is" is a first phrase and "two-twenty" is a second phrase. Speech data, which correspond to these phrases, are stored at their addresses in the data ROM 34, and their initial addresses are stored in the address ROM 32. At first, a control signal Sc, which is applied to the timing control circuit 39, is set at an H level when an analog speech signal So, which corresponds to the first phrase, is outputted. When the first and the second phrase signals Sf designating the first and the second phrases are applied serially to the input terminal IN from an external device, the latch circuit 31 is instructed from the timing control circuit 39 to latch these phrase signals Sf, and then sends the first phrase signal Sf to the address ROM 32.

The address ROM 32 selects a first address area, which corresponds to the first phrase signal Sf. Then, the address ROM 32 sends a minimum address in the first address area, as the first initial address As indicating the top of the first phrase, to the preset terminal of the address counter 33.

The address counter 33 counts up from the first initial address As, and produces addresses corresponding to the phrase. Then, the first address is sent to the data ROM 34. In response, the data ROM 34 send first speech data S34, which corresponds to the first address, to the speech synthesizing circuit 35.

In the speech synthesizing circuit 35, the first speech data S34 is synthesized by the instruction from the timing control circuit 39, and the synthesized speech data are expanded to first PCM data S35. Then, the first PCM data S35 is sent to the selector 36.

Since the control signal Sc is at the H level, the timing control circuit 39 outputs the select signal SEL having the H level to the selector 36 in order to make the selector 36 select the first PCM data S35. Therefore, the selector 36 transfers the first PCM data S35 to the DAC 37.

The DAC 37 decodes the first PCM data S35 to produce a first analog signal S37, and then sends the first analog signal S37 to the LPF 38. The LPF 38 filters high frequencies out from the first analog signal S37 in order to produce an first analog speech signal So, which corresponds to the first phrase. The first analog speech signal So is outputted from the speech output terminal OUT as a result of the speech synthesis to an external device such as a speaker. After the first PCM data S35 is outputted from the selector 36, the second phrase signal, which is latched in the latch circuit 31, is outputted to the address ROM 32 under the control of the timing control circuit 39. In the same manner used to synthesize the first phrase as described above, second PCM data based on the second phrase signal is outputted from the speech synthesizing circuit 35.

To insert silence between the first and the second phrases, the control signal Sc is set at an L level after the first PCM data S35 is outputted from the selector 36, and the silence-length data Dt is supplied to the input terminal IN. Here, since the silence-length data Dt can be stored in the latch circuit 31, the silence-length data Dt can be inputted anytime before the first PCM data S35 is outputted from the selector 36. When the control signal having the L level is applied to the timing control circuit 39, the timing control circuit 39 outputs the select signal SEL having the L level for making the selector 16 select its input, which is connected to the ground GND. The ground voltage GND is equivalent of "0" in PCM data S35. Therefore, when the ground voltage GND is applied to the DAC 37, the DAC 37 outputs the signal-ground voltage, which corresponds to "0", to the LPF 38. A described above, the signal-ground voltage is set at around ½ VDD.

When the signal-ground voltage is applied to the LPF 38, the LPF 38 outputs a signal-ground voltage SG, which is generated by the reference voltage generating circuit 18*a*, to the speech output terminal OUT, whereby silence is outputted from the speech synthesizer 30.

In the meantime, the silence-length data Dt, which is applied to the input terminal IN, is latched in the latch circuit 31 under the control of the timing control circuit 39 as described. When sending the select signal SEL having the L level to the selector 36, the timing control circuit 39 also sends the timing control signal TCS to the latch circuit 31. When receiving the timing control signal TCS, the latch circuit 31 recognizes that a period of silence has started, and sends the silence-length data Dt to the preset terminal of the counter 40

A countdown of the preset silence-length data Dt is performed in the counter 40. When the counter 40 indicates "0" as a result of the countdown, the timing control circuit 39 outputs the select signal having the H level to the selector 36. When the selector 36 receives the select signal having the H level, the selector 36 selects the input signal from the speech synthesizing circuit 35 again, whereby the period for the silence is ended, and the second PCM data S35 produced from the second phrase signal is outputted to the DAC 37.

As described above, the period of silence, which corresponds to the silence-length data Dt, is set by the counter 40, and the silence is inserted between the first and the second phrases by the selector 36.

Thus, for the insertion of silence between phrases, the speech synthesizer according to the second embodiment are as follows. First, the second latch circuit 20 and the silence-length terminal SLT of the first embodiment are removed from the speech synthesizer 30 of the second embodiment. Second, the speech synthesizer 30 includes the counter 40 having the input terminal, which is connected to the output of the latch circuit 31.

In the second embodiment, the silence is started when the selector 36 selects the ground potential GND, and is ended when the counter 40 indicates "0" as a result of the count-down operation. According to the second embodiment, it is not necessary to store the silence data in the data ROM 34 in order to insert the silence between the phrases. Therefore, it is possible to insert the silence between the phrases without increasing the memory capacity.

Further, according to the second embodiment, the silence-length data Dt is applied to the latch circuit 31 via the input terminal IN, and the silence-length data Dt latched in the latch circuit 31 is applied to the counter 40. Therefore, it is not necessary to form a terminal exclusively used for receiving the silence-length data Dt so that the number of terminals of the IC chip can be reduced. Similarly, it is not necessary to form a second latch circuit exclusively used for latching the silence-length data Dt so that the size of the IC chip can be reduced.

Third Preferred Embodiment

Figure 3:
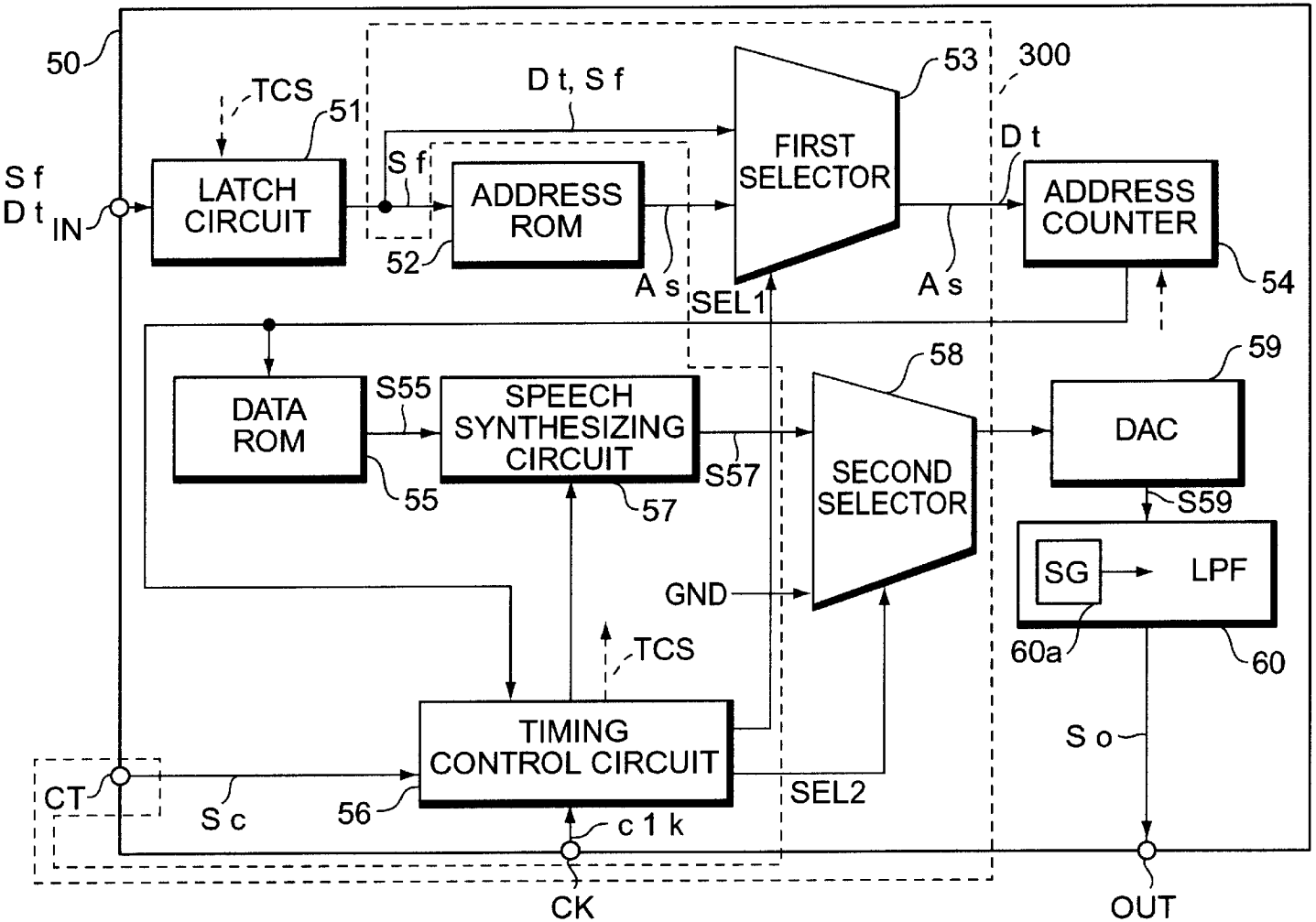
FIG. 3 is a block diagram of a speech synthesizer according to a third embodiment of the invention.

Referring to FIG. 3, a speech synthesizer 50 includes an input terminal IN, a latch circuit 51, an address read only memory (ROM) 52, an address counter 54 having a preset terminal, a data ROM 55, a speech synthesizing circuit 57, a digital/analog converter (DAC) 59, a low pass filter(LPF) 60, a timing control circuit 56, and a silence-input means 300. The silence-input means 300 is for inserting silence between phrases, and includes a first two-input selector 53, a second two-input selector 58 and a control terminal CT.

The speech synthesizer 50, which is formed in an IC chip, receives phrase signals Sf, each of which designates one of the phrases of a sentence and silence-length data Dt, at the input terminal IN. The phrase signals Sf and silence-length data Dt are supplied from an external device. The input terminal IN is connected to the latch circuit 51. As well as the latch circuit 31 of the second embodiment shown in FIG. 2, the latch circuit 51 latches not only the phrase signal Sf, but also the silence-length data Dt. An output terminal of the latch circuit 51 is connected to the address ROM 52 and one of the two data inputs of the first selector 53

An output terminal of the address ROM 52 is connected to the other data input of the first selector 53. An output of the first selector 53 is connected to the preset terminal of the address counter 54. In the address ROM 52, address data are stored, and each address data shows an initial address of one of speech data stored in the data ROM 55. The address ROM 52 sends the initial address As to the address counter 54. The address counter 54, which is different from the address counters 13, 33 used in the first and the second embodiments, has an up-down counter. Therefore, the address counter 54 performs up-counting or down-counting operation, and produces addresses corresponding to the phrase signals one-by-one. An output terminal of the address counter 54 is connected to the timing control circuit 56 and the data ROM 55, which is used for a speech data memory. An output terminal of the data ROM 55 is connected to the speech synthesizing circuit 57.

An output terminal of the speech synthesizing circuit 57 is connected to one of two data input terminals of the second two-input selector 58 of the silence-input means 200. The other data input terminal of the first two-input selector 58 is connected to ground GND. An output of the second two-input selector 58 is connected to the DAC 59. An output of the DAC 59 is connected to the LPF 60.

The data ROM 55 stores speech data S55 in Adaptive Differential Pulse Code Modulation (ADPCM) format, which must be decoded, wherein the speech data S55 stored in each address in the data ROM 55 corresponds to one of the phrases. However, since the content in the data ROM 55 is just a list of data in ADPCM format, a start and an end of each phrase can not be recognized by simply referring the content in the data ROM 55. That is, each phrase can not be recognized. To recognize each phrase, it is necessary to refer to the address data stored in the address ROM 52 in addition to referring to the speech data S55 in the data ROM 55.

The speech synthesizing circuit 57 expands the speech data S55 to the Pulse Code Modulation (PCM) data S57 by decoding. The PCM data S57 is transformed into an analog signal S59 in the DAC 59. The LPF 60 filters high frequencies out from the analog signal S59 outputted from the DAC 59, and then produces an analog speech signal So, which corresponds to the phrase, from the filtered analog signal.

The LPF 60 includes a plurality of operational amplifiers and a reference voltage generating circuit 60*a*. The reference voltage generating circuit 60*a* generates a signal-ground voltage SG, which serves as a reference voltage for each operational amplifier. The level of the signal-ground voltage is set at ½ level of the power supply voltage VDD. That is, the level of the signal-ground voltage is set around the center level of a whole analog speech waveform. Silence can be obtained by maintaining the output continuously at the signal-ground level for a particular period. An output terminal of the LPF 60 is connected to a speech output terminal OUT.

The speech synthesizer 50 also includes a clock terminal CK for receiving a clock signal, as in the speech synthesizer 30 shown in FIG. 2 in addition to the control terminal CT for receiving a control signal Sc. The control terminal CT and the clock terminal CK are connected to the timing control circuit 56.

The timing control circuit 56 controls the timing of the latch circuit 51, the address counter 54 and the speech synthesizing circuit 57 based on the clock signal Clk, which is applied to the clock terminal CK. Further, the timing control circuit 56 outputs a first and a second select signal SEL1, SEL2, which are formed from a result of counting operation of the address counter 54 and the control signal Sc, to the select terminals of the first and the second selector 53, 58, respectively.

An operation of the speech synthesizer 50 shown in FIG. 3 is explained as follows using "It is two-twenty" as an example of a sentence to be synthesized. In this case, "It is" is a first phrase and "two-twenty" is a second phrase. Speech data, which correspond to these phrases, are stored at their addresses in the data ROM 55, and their initial addresses are stored in the address ROM 52. At first, a control signal Sc, which is applied to the timing control circuit 56, is set at an H level when an analog speech signal So, which corresponds to the first phrase, is outputted. When the first and the second phrase signals Sf designating the first and second phrase are applied serially to the input terminal IN from an external device, the latch circuit 51 is instructed from the timing control circuit 56 to latch these phrase signals Sf, and then sends the first phrase signal Sf to the address ROM 52.

The address ROM 52 selects a first address area, which corresponds to the first phrase signal Sf. Then, the address ROM 52 sends a minimum address in the first address area, as the first initial address As indicating the top of the first phrase, to the first selector 53. Therefore, the first selector 53 receives the first phrase signal Sf and the first initial address As at its inputs.

When the control signal Sc having the H level is applied to the timing control signal 56, the timing control signal 56 outputs the first select signal SELL having the H level to the first selector 53 in order to make the first selector 53 select the output signal outputted from the address ROM 52. Therefore, since the first selector 53 selects the first initial address As, the first initial address As is applied to a preset terminal of the address counter 54.

The address counter 54 counts up from the first initial address As under the control of the timing control circuit 56, and produces a first address corresponding to the first phrase. Then, the first address is sent to the data ROM 55. In response, the data ROM 55 sends speech data S55, which corresponds to the first address, to the speech synthesizing circuit 57.

In the speech synthesizing circuit 57, the first speech data S55 is synthesized by the instruction from the timing control circuit 56, and the synthesized speech data are expanded to first PCM data S57. Then, the first PCM data S57 is sent to the second selector 58.

Since the control signal Sc is at the H level, the timing control circuit 56 outputs the second select signal SEL2 having the H level to the second selector 58 in order to make the second selector 58 select the first PCM data S57. Therefore, the second selector 58 transfers the first PCM data S57 to the DAC 59.

The DAC 59 decodes the first PCM data S57 to produce a first analog signal S59, and then sends the first analog signal S59 to the LPF 60. The LPF 60 filters high frequencies out from the first analog signal S59 in order to produce a first analog speech signal So, which corresponds to the first phrase. The first analog speech signal So is outputted from the speech output terminal OUT as a result of the speech synthesis to an external device such as a speaker. After the first PCM data S57 is outputted from the second selector 58, the second phrase signal, which is latched in the latch circuit 51, is outputted to the address ROM 52 under the control of the timing control circuit 56. In the same manner used to synthesize the first phrase as described above, second PCM data based on the second phrase signal is outputted from the speech synthesizing circuit 57.

To insert silence between the first and the second phrases, the control signal Sc is set at an L level after the first PCM data S57 is outputted from the second selector 58, and the silence-length data Dt is supplied to the input terminal IN. Here, since the silence-length data Dt can be stored in the latch circuit 51, the silence-length data Dt can be inputted anytime before the first PCM data S57 is outputted from the second selector 58. When the control signal having the L level is applied to the timing control circuit 56, the timing control circuit 56 outputs the first select signal SEL1 having the L level for making the first selector 53 select its input, which is connected to the output terminal of the latch circuit 51, and also outputs the second select signal SEL 2 having the L level for making the second selector 58 select its input, which is connected to the ground potential GND. The ground voltage GND is equivalent of "0" in PCM data S57. Therefore, when the ground voltage GND is applied to the DAC 59, the DAC 59 outputs the signal-ground voltage, which corresponds to "0", to the LPF 60. A described above, the signal-ground voltage is set at around ½ VDD.

When the signal-ground voltage is applied to the LPF 80, the LPF 80 outputs a signal-ground voltage SG, which is generated by the reference voltage generating circuit 18*a*, to the speech output terminal OUT, whereby silence is outputted from the speech synthesizer 50.

In the meantime, the silence-length data Dt, which is applied to the input terminal IN, is latched in the latch circuit 51 under the control of the timing control circuit 56 as described. When sending the second select signal SEL2 having the L level to the second selector 58, the timing control circuit 56 also sends the timing control signal TCS to the latch circuit 51. When receiving the timing control signal TCS, the latch circuit 51 recognizes that a period of silence has started, and sends the silence-length data Dt to the preset terminal of the address counter 54 via the first selector 53.

When the address counter 54 receives the silence-length data Dt, the countdown operation using the silence-length data Dt is performed in the address counter 54 under the control of the timing control circuit 56. When the address counter 54 indicates "0" as a result of the countdown, the timing control circuit 56 outputs the first select signal SEL1 having the H level to the first selector 53 and outputs the second select signal SEL2 having the H level to the second selector 58. When the second selector 58 receives the second select signal SEL2 having the H level, the second selector 58 selects the input signal from the speech synthesizing circuit 35 again. When the first selector 53 receives the first select signal SEL1 having the H level, the first selector 53 selects the input signal from the address ROM 52 again, whereby the period for the silence is ended, and the second PCM data S57 produced from the second phrase signal is outputted to the DAC 59

As described above, the period of silence, which corresponds to the silence-length data Dt, is set by the address counter 54, and the silence is inserted between the first and the second phrases by the second selector 58.

Thus, for the insertion of silence between phrases, the speech synthesizer according to the third embodiment are as follows. First, the counter 40 of the second embodiment are removed from the speech synthesizer 50 of the third embodiment. Second, the speech synthesizer 30 includes the address counter 40 having the output terminal, which is connected to the timing control circuit, and the first selector 53.

In the third embodiment, the silence is started when the second selector 58 selects the ground potential GND, and is ended when the address counter 54 indicates "0" as a result of the countdown operation. According to the third embodiment, it is not necessary to store the silence data in the data ROM 55 in order to insert the silence between the phrases. Therefore, it is possible to insert the silence between the phrases without increasing the memory capacity.

Further, according to the third embodiment, the silence-length data Dt is applied to the latch circuit 51 via the input terminal IN, and the silence-length data Dt latched in the latch circuit 51 is applied to the address counter 54 via the first selector 53. Therefore, it is not necessary to form a terminal exclusively used for receiving the silence-length data Dt so that the number of terminals of the IC chip can be reduced. Similarly, it is not necessary to form a counter exclusively used for setting the length the silence based on the silence-length data Dt so that the size of the IC chip can be reduced. Compared the speech synthesizer 50 of the third embodiment with the speech synthesizer 30 of the second embodiment, the speech synthesizer 50 of the third embodiment includes two selectors 53, 58. However, since the size of each of the selectors are smaller than that of the counter, it is still expected to reduce the IC chip size.

Fourth Preferred Embodiment

Figure 4:
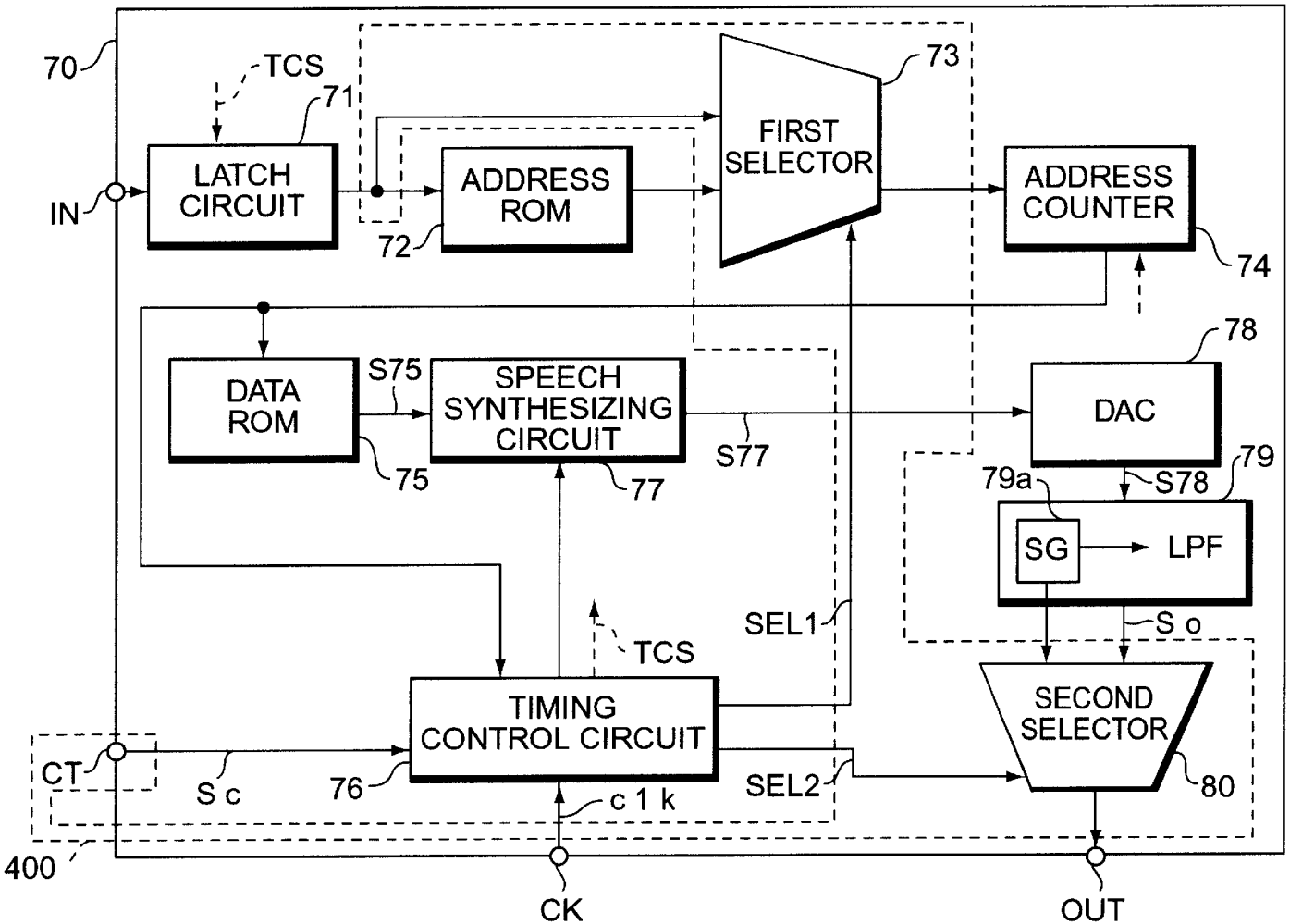
FIG. 4 is a block diagram of a speech synthesizer according to a fourth embodiment of the invention.

Referring to FIG. 4, a speech synthesizer 70 includes an input terminal IN, a latch circuit 71, an address read only memory (ROM) 72, an address counter 74 having a preset terminal, a data ROM 75, a speech synthesizing circuit 77, a digital/analog converter (DAC) 78, a low pass filter(LPF) 79, a timing control circuit 76, and a silence-input means 400. The silence-input means 400 is for inserting silence between phrases, and includes a first two-input selector 73, a second two-input selector 80 and a control terminal CT.

The speech synthesizer 70, which is formed in an IC chip, receives phrase signals Sf, each of which designates one of the phrases of a sentence and silence-length data Dt, at the input terminal IN. The phrase signals Sf and silence-length data Dt are supplied from an external device. The input terminal IN is connected to the latch circuit 71. As well as the latch circuits 31, 51 of the second and the third embodiments shown in FIGS. 2 and 3, the latch circuit 71 latches not only the phrase signal Sf, but also the silence-length data Dt. An output terminal of the latch circuit 71 is connected to the address ROM 72 and one of the two data inputs of the first selector 73.

An output terminal of the address ROM 72 is connected to the other data input of the first selector 73. An output of the first selector 73 is connected to the preset terminal of the address counter 74. In the address ROM 72, address data are stored, and each address data shows an initial address of one of speech data stored in the data ROM 75. The address ROM 72 sends the initial address As, which is in an address area corresponding to the phrase, to the address counter 74. As well as the address counter 54 of the third embodiment shown in FIG. 3, the address counter 74 has an up-down counter. Therefore, the address counter 74 performs up-counting or down-counting operation, and produces addresses corresponding to the phrase signals one-by-one. An output terminal of the address counter 74 is connected to the timing control circuit 76 and the data ROM 75, which is used for a speech data memory. An output terminal of the data ROM 75 is connected to the speech synthesizing circuit 77.

An output terminal of the speech synthesizing circuit 77 is connected to the DAC 78. An output of the DAC 78 is connected to the LPF 79.

The data ROM 75 stores speech data S75 in Adaptive Differential Pulse Code Modulation (ADPCM) format, which must be decoded, wherein the speech data S75 stored in each address in the data ROM 75 corresponds to one of the phrases. However, since the content in the data ROM 75 is just a list of data in ADPCM format, a start and an end of each phrase can not be recognized by simply referring the content in the data ROM 75. That is, each phrase can not be recognized. To recognize each phrase, it is necessary to refer to the address data stored in the address ROM 72 in addition to referring to the speech data S75 in the data ROM 75.

The speech synthesizing circuit 77 expands the speech data S75 to the Pulse Code Modulation (PCM) data S77 by decoding. The PCM data S77 is transformed into an analog signal S78 in the DAC 78. The LPF 79 filters high frequencies out from the analog signal S78 outputted from the DAC 78, and then produces an analog speech signal So, which corresponds to the phrase, from the filtered analog signal.

The LPF 79 includes a plurality of operational amplifiers and a reference voltage generating circuit 79*a*. The reference voltage generating circuit 79*a* generates a signal-ground voltage SG, which serves as a reference voltage for each operational amplifier. The level of the signal-ground voltage is set at ½ level of the power supply voltage VDD. That is, the level of the signal-ground voltage is set around the center level of a whole analog speech waveform. Silence can be obtained by maintaining the output continuously at the signal-ground level for a particular period. An output terminal of the LPF 79 is connected to one of two data input terminals of the second selector 80. The other data input terminal of the second selector 80 is connected to the reference voltage generating circuit 79*a* of the LPF 79. The second selector 80 receives a second select signal SEL 2 outputted from the timing control circuit 76 at its select terminal.

The speech synthesizer 70 also includes a clock terminal CK for receiving a clock signal, as in the speech synthesizer 50 shown in FIG. 3 in addition to the control terminal CT for receiving a control signal Sc. The control terminal CT and the clock terminal CK are connected to the timing control circuit 76.

The timing control circuit 76 controls the timing of the latch circuit 71, the address counter 74 and the speech synthesizing circuit 77 based on the clock signal Clk, which is applied to the clock terminal CK. Further, the timing control circuit 76 outputs a first and a second select signal SEL1, SEL2, which are formed from a result of counting operation of the address counter 74 and the control signal Sc, to the select terminals of the first and the second selector 53, 58, respectively, An operation of the speech synthesizer 70 shown in FIG. 4 is explained as follows using "It is two-twenty" as an example of a sentence to be synthesized, in the second embodiment. In this case, "It is" is a first phrase and "two-twenty" is a second phrase. Speech data, which correspond to these phrases, are stored at their addresses in the data ROM 75, and their initial addresses are stored in the address ROM 72. At first, a control signal Sc, which is applied to the timing control circuit 76, is set at an H level when an analog speech signal So, which corresponds to the first phrase, is outputted. When the first and the second phrase signals Sf designating the first and the second phrase are applied serially to the input terminal IN from an external device, the latch circuit 71 is instructed from the timing control circuit 76 to latch these phrase signals Sf, and then sends the first phrase signal Sf to the address ROM 72.

The address ROM 72 selects a first address area, which corresponds to the first phrase signal Sf. Then, the address ROM 72 sends a minimum address in the first address area, as the first initial address As indicating the top of the first phrase, to the first selector 73. Therefore, the first selector 73 receives the first phrase signal Sf and the first initial address As at its inputs.

When the control signal Sc having the H level is applied to the timing control signal 76, the timing control signal 76 outputs the first select signal SEL1 having the H level to the first selector 73 in order to make the first selector 73 select the output signal outputted from the address ROM 72. Therefore, since the first selector 73 selects the first initial address As, the first initial address As is applied to a preset terminal of the address counter 74.

The address counter 74 counts up from the first initial address As under the control of the timing control circuit 56, and produces a first address corresponding to the first phrase. Then, the first address is sent to the data ROM 75. In response, the data ROM 75 sends speech data S75, which corresponds to the first address, to the speech synthesizing circuit 77.

In the speech synthesizing circuit 77, the first speech data S75 is synthesized by the instruction from the timing control circuit 76, and the synthesized speech data are expanded to first PCM data S77. Then, the first PCM data S77 is sent to the DAC78.

The DAC 78 decodes the first PCM data S77 to produce a first analog signal S78, and then sends the first analog signal S78 to the LPF 79. The LPF 79 filters high frequencies out from the first analog signal S78 in order to produce a first analog speech signal So, which corresponds to the first phrase.

Since the timing control circuit 76 is now receiving the control signal having the H level, the timing control circuit 76 outputs the second select signal SEL2 having the H level to the second selector 80 in order to make the second selector 80 select the first analog speech signal So from the LPF 79. Therefore, the first analog speech signal So is outputted from the speech output terminal OUT as a result of the speech synthesis to an external device such as a speaker. After the first PCM data S77 is outputted from the second selector 80, the second phrase signal, which is latched in the latch circuit 71, is outputted to the address ROM 72 under the control of the timing control circuit 76. In the same manner used to synthesize the first phrase as described above, second PCM data based on the second phrase signal is outputted from the speech synthesizing circuit 77, and then is inputted to the second selector 80 via the DAC 78 and the LPF 79.

To insert silence between the first and the second phrases, the control signal Sc is set at an L level after the first analog speech signal So is outputted from the second selector 80, and the silence-length data Dt is supplied to the input terminal IN. Here, since the silence-length data Dt can be stored in the latch circuit 71, the silence-length data Dt can be inputted anytime before first analog speech signal So is outputted from the second selector 80. When the control signal having the L level is applied to the timing control circuit 76, the timing control circuit 56 outputs the first select signal SEL1 having the L level for making the first selector 73 select its input, which is connected to the output terminal of the latch circuit 71, and also outputs the second select signal SEL 2 having the L level for making the second selector 80 select its input, which is connected to the reference voltage generating circuit 79*a*. When the second selector 80 selects the output of the reference voltage generating circuit 79*a*, the signal-ground voltage SG generated by the reference voltage generating circuit 79*a* is outputted to the speech output terminal OUT. A described above, since the signal-ground voltage is set at around ½ VDD, silence is outputted from the speech synthesizer 70.

In the meantime, the silence-length data Dt, which is applied to the input terminal IN, is latched in the latch circuit 71 under the control of the timing control circuit 76 as described. When sending the second select signal SEL2 having the L level to the second selector 80, the timing control circuit 76 also sends the timing control signal TCS to the latch circuit 71. When receiving the timing control signal TCS, the latch circuit 71 recognizes that a period of silence has started, and sends the silence-length data Dt to the preset terminal of the address counter 74 via the first selector 73.

When the address counter 74 receives the silence-length data Dt, the countdown operation using the silence-length data Dt is performed in the address counter 74 under the control of the timing control circuit 76. When the address counter 74 indicates "0" as a result of the countdown, the timing control circuit 76 outputs the first select signal SEL1 having the H level to the first selector 73 and outputs the second select signal SEL2 having the H level to the second selector 80. When the second selector 80 receives the second select signal SEL2 having the H level, the second selector 80 selects the input signal from the LPF 79 again. When the first selector 73 receives the first select signal SEL1 having the H level, the first selector 73 selects the input signal from the address ROM 72 again, whereby the period for the silence is ended, and the second analog speech signal So produced from the second phrase signal is selected by the second selector 80.

According to the fourth embodiment, the second selector 80 is formed between the LPF 79 and the speech output terminal OUT, not between the speech synthesizing circuit 77 and the DAC 78. That is, the speech synthesizer 70 of the fourth embodiment can select one of the output signals from the LPF 79 or the signal-ground voltage SG just before outputting it to the speech output terminal OUT Therefore, since the speech synthesizer 70 can output the signal-ground voltage regardless of the output condition form the DAC 78 and the LPF 79, silence without noise can be obtained.

While the invention has been described with reference to illustrative embodiments, this description is not intended to be construed in a limiting sense. For example, the LPF, which includes a plurality of operational amplifiers, is disclosed in each embodiment. However, a LPF including a switched capacitor filter may be used in each embodiment. Further, although the data ROM is incorporated in the IC chip in each embodiment, an external data ROM, which is not incorporated in the IC chip, may be used in each embodiment. Furthermore, although silence is inserted between the phrases in all embodiments, it is possible to insert silence between words if the data ROM stores words, not phrases.

Various other modifications of the illustrated embodiments, as well as other embodiments of the invention, will be apparent to those skilled in the art on reference to this description. Therefore, the appended claims are intended to cover any such modifications or embodiments as fall within the true scope of the invention.

We claim:

1. A speech synthesizer, comprising:

a first input terminal at which a phrase signal is inputted;

a second input terminal at which a silence length data is inputted;

a data memory having a plurality of address areas, which stores a plurality of phrases in the address areas;

an address designating circuit designating one of the address areas based on the phrase signal;

a speech synthesizing circuit generating a speech synthesizing signal corresponding to the phrase stored in the designated area;

a digital/analog converter transforming the speech synthesizing signal to an analog signal; and a silence-input circuit including a counter and silence-input means, the counter setting a period of silence based on the silence length data inputted at the second input terminal, the silence-input means being connected between the speech synthesizing circuit and the digital/analog converter, and supplying a predetermined voltage to the digital/analog converter for the period that is set by the counter.

2. A speech synthesizer as claimed in claim 1, wherein the predetermined voltage is a ground voltage.

3. A speech synthesizer as claimed in claim 1, wherein the digital/analog converter outputs the analog signal having a center amplitude level of the analog signal, when the predetermined voltage is supplied to the digital/analog converter.

4. A speech synthesizers, comprising:

a first input terminal at which a phrase signal is inputted;

a second input terminal at which a silence length data is inputted;

a data memory having a plurality of address areas, which stores a plurality of phrases in the address areas;

an address designating circuit designating one of the address areas based on the phrase signal;

a speech synthesizing circuit generating a speech synthesizing signal corresponding to the phrase stored in the designated area;

a digital/analog converter transforming the speech synthesizing signal to an analog signal;

a silence-input circuit including a counter and silence-input means, the counter setting a period of silence based on the silence length data inputted at the second input terminal, the silence-input means being connected between the speech synthesizing circuit and the digital/analog converter, and supplying a predetermined voltage to the digital/analog converter for the period that is set by the counter, and a first latch circuit receiving the phrase signal inputted at the first input terminal, wherein the silence-input means includes a second latch circuit receiving the silence length data inputted at the second input terminal, and outputting the latched silence length data to the counter, and a selector, in responses to a voltage level of a selection signal inputted thereto, selecting one of the a speech synthesizing signal from the speech synthesizing circuit and a signal having a predetermined voltage, and outputting the selected signal to the digital/analog converter.

5. A speech synthesizer as claimed in claim 4, further comprising a timing control circuit whose output connects a control terminal of the selector, wherein the timing control circuit outputs the selection signal for selecting the signal having the predetermined voltage in response to a control signal, and outputs the selection signal for selecting the speech synthesizing signal in response to an output of the counter.

6. A speech synthesizer, comprising:

an input terminal at which a phrase signal corresponding to a phrase is inputted and silence length data for setting a period of silence is inputted;

a data memory having a plurality of address areas, which stores a plurality of phrases in the address areas;

a single latch circuit receiving the phrase signal and the silence length data;

a counter receiving the phrase signal and the silence length data from the single latch circuit, the counter designating one of the address areas when the phrase signal is received, and setting for the period of silence when silence length data is received;

a speech synthesizing circuit generating a speech synthesizing signal corresponding to the phrase stored in the designated area;

a digital/analog converter transforming the speech synthesizing signal to an analog signal; and silence-input means being connected between the speech synthesizing circuit and the digital/analog converter, and supplying a predetermined voltage to the digital/analog converter for the period that is set by the counter.

7. A speech synthesizer as claimed in claim 6, wherein the predetermined voltage is a ground voltage.

8. A speech synthesizer as claimed in claim 6, wherein the digital/analog converter outputs the analog signal having a center amplitude level of the analog signal, when the predetermined voltage is supplied to the digital/analog converter.

9. A speech synthesizer as claimed in claim 6, further comprising:

an address designating circuit designating one of the address areas based on the phrase signal, wherein the silence-input means includes a first selector having two inputs and one output, one input being connected to the single latch circuit, and another being connected to the address designating circuit, the first selector, in responses to a voltage level of a first selection signal inputted thereto, selecting one of a phrase signal from the address designating circuit and the silence length data from the single latch circuit, and outputting the first selected signal to the counter.

10. A speech synthesizer as claimed in claim 9, wherein the silence-input means includes a second selector, in responses to a voltage level of a second selection signal inputted thereto, selecting one of the a speech synthesizing signal from the speech synthesizing circuit and a signal having a predetermined voltage, and outputting the second selected signal to the digital/analog converter.

11. A speech synthesizer as claimed in claim 10, further comprising a timing control circuit whose output connects control terminal of the first and second selectors, wherein the timing control circuit outputs the first selection signal for selecting the silence length data in response to a control signal, outputs the second selection signal for selecting the signal having the predetermined voltage in response to the control signal, and outputs the second selection signal for selecting the speech synthesizing signal in response to an output of the counter.

12. A speech synthesizer having an output which outputs a result of the speech synthesizer, comprising:

an input terminal at which a phrase signal corresponding to a phrase is inputted and silence length data for setting a period of silence is inputted;

a data memory having a plurality of address areas, which stores a plurality of phrases in the address areas;

a counter receiving the phrase signal and the silence length data, the counter designating one of the address areas when the phrase signal is received, and setting for the period of silence when silence length data is received;

a speech synthesizing circuit generating a speech synthesizing signal corresponding to the phrase stored in the designated area;

a digital/analog converter transforming the speech synthesizing signal to an analog signal;

a filter circuit including a reference voltage generating circuit, which filters the analog signal outputted from the digital/analog converter, the reference voltage generating circuit generating a reference voltage; and silence-input means being connected between the filter and the output terminal, transferring the reference voltage to the output terminal for the period which is set by the counter, and transferring an output signal of the filter to the output terminal for another period other than the period set by the counter.

13. A speech synthesizer as claimed in claim 12, wherein the digital/analog converter outputs the analog signal having a center amplitude level of the analog signal, when the predetermined voltage is supplied to the digital/analog.

14. A speech synthesizer as claimed in claim 12, further comprising:

an address designating circuit designating one of the address areas based on the phrase signal, wherein the silence-input means includes a first selector having two inputs and one output, one input being connected to the single latch circuit, and another being connected to the address designating circuit, the first selector, in responses to a voltage level of a first selection signal inputted thereto, selecting one of a phrase signal from the address designating circuit and the silence length data from the single latch circuit, and outputting the first selected signal to the counter.

15. A speech synthesizer as claimed in claim 14, wherein the silence-input means includes a second selector, in responses to a voltage level of a second selection signal inputted thereto, selecting one of the signals from the reference voltage generating circuit and the filter circuit.

16. A speech synthesizer as claimed in claim 15, further comprising a timing control circuit whose output connects control terminal of the first and second selectors, wherein the timing control circuit outputs the first selection signal for selecting the silence length data in response to a control signal, outputs the second selection signal for selecting the signal from the reference voltage generating circuit in response to the control signal, and outputs the second selection signal for selecting the signal from the filter circuit in response to an output of the counter.

17. A speech synthesizer as claimed in claim 12 wherein the reference voltage is ½ Vdd.

18. A speech synthesizer, comprising:

an input terminal at which a phrase signal corresponding to a phrase is inputted and silence length data for setting a period of silence is inputted;

a single latch circuit receiving the phrase signal and the silence length data;

a data memory having a plurality of address areas, which stores a plurality of phrases in the address areas;

an address designating circuit designating one of the address areas based on the phrase signal;

a speech synthesizing circuit generating a speech synthesizing signal corresponding to the phrase stored in the designated area;

a digital/analog converter transforming the speech synthesizing signal to an analog signal; and a silence-input circuit including a counter and silence-input means, the counter setting a period of silence by the silence length data from the single latch circuit, the silence-input means being connected between the speech synthesizing circuit and the digital/analog converter, and supplying a predetermined voltage to the digital/analog converter for the period that is set by the counter.

19. A speech synthesizer as claimed in claim 18, wherein the predetermined voltage is a ground voltage.

20. A speech synthesizer as claimed in claim 18, wherein the digital/analog converter outputs the analog signal having a center amplitude level of the analog signal, when the predetermined voltage is supplied to the digital/analog converter.

21. A speech synthesizer as claimed in claim 18, wherein the silence-input means a selector, in responses to a voltage level of a selection signal inputted thereto, selecting one of the a speech synthesizing signal from the speech synthesizing circuit and a signal having a predetermined voltage, and outputting the selected signal to the digital/analog converter.

22. A speech synthesizer as claimed in claim 21, further comprising a timing control circuit whose output connects a control terminal of the selector, wherein the timing control circuit outputs the selection signal for selecting the signal having the predetermined voltage in response to a control signal, and outputs the selection signal for selecting the speech synthesizing signal in response to an output of the counter.

* * * * *